US008978222B2

(12) United States Patent
Ferreira et al.

(10) Patent No.: US 8,978,222 B2
(45) Date of Patent: Mar. 17, 2015

(54) TOOL FOR REMOVING ANNULAR ELEMENTS TIGHTLY MOUNTED IN HOLES, IN PARTICULAR BLIND HOLES, OF PARTS

(75) Inventors: Antoine Ferreira, Aren (FR); Rene Petuya, Gurmencon (FR); Yannig Vaillant, Oloron Sainte Marie (FR)

(73) Assignee: Messier-Bugatti-Dowty, Velizy-Villacoublay (FR)

( * ) Notice: Subject to any disclaimer, the term of this patent is extended or adjusted under 35 U.S.C. 154(b) by 636 days.

(21) Appl. No.: 13/387,620

(22) PCT Filed: Jul. 23, 2010

(86) PCT No.: PCT/EP2010/060744
§ 371 (c)(1),
(2), (4) Date: Jan. 27, 2012

(87) PCT Pub. No.: WO2011/012552
PCT Pub. Date: Feb. 3, 2011

(65) Prior Publication Data

US 2012/0131778 A1 May 31, 2012

(30) Foreign Application Priority Data

Jul. 28, 2009 (FR) ..... 09 03698

(51) Int. Cl.
*B25B 27/06* (2006.01)

(52) U.S. Cl.
CPC ..... *B25B 27/062* (2013.01)
USPC ..... 29/265; 29/255; 29/256; 29/278

(58) Field of Classification Search
CPC ..... B25B 3/00; B25B 27/00; B23P 19/04; B23Q 3/00
USPC ..... 29/265, 270, 255, 278, 272, 256, 280
See application file for complete search history.

(56) References Cited

U.S. PATENT DOCUMENTS

| | | | |
|---|---|---|---|
| 1,728,248 | A | 9/1929 | Naggy et al. |
| 2,646,619 | A | 7/1953 | McCord |
| 4,724,608 | A | 2/1988 | Parrott |

(Continued)

FOREIGN PATENT DOCUMENTS

| | | |
|---|---|---|
| DE | 1 291 298 | 7/1969 |
| DE | 2 042 044 | 3/1972 |
| DE | 201 13 561 | 10/2001 |

OTHER PUBLICATIONS

International Search Report Issued Oct. 25, 2010 in PCT/EP10/60744 Filed Jul. 23, 2010.

*Primary Examiner* — Lee D Wilson
(74) *Attorney, Agent, or Firm* — Oblon, McClelland, Maier & Neustadt, L.L.P.

(57) ABSTRACT

A removal tool which exerts an axial pull on an annular element including a tie rod with a widened end head adapted to be inserted in the coaxial passage of the annular element, beyond the annular element, and a mechanism for engaging with the element in a form of an annular cage with lateral prongs capable of deforming elastically in the radial direction, passing through the axial passage to engage via the elastic prongs thereof with the distal transverse surface of the element and to allow the element to be removed by the engagement of the widened head with the prongs, following the axial movement of the tie rod outside of the hole by a control mechanism.

9 Claims, 5 Drawing Sheets

(56) References Cited

U.S. PATENT DOCUMENTS

| | | | | |
|---|---|---|---|---|
| 5,249,342 | A | 10/1993 | Smith | |
| 5,276,951 | A | 1/1994 | Gluszek | |
| 6,012,358 | A * | 1/2000 | Lins et al. | 81/13 |
| 7,698,795 | B2 * | 4/2010 | Brock et al. | 29/274 |
| 2009/0139071 | A1 * | 6/2009 | Palka | 29/259 |
| 2011/0094076 | A1 * | 4/2011 | Liu | 29/244 |
| 2012/0131778 | A1 * | 5/2012 | Ferreira et al. | 29/265 |
| 2014/0047688 | A1 * | 2/2014 | Chen | 29/256 |

* cited by examiner

TOOL FOR REMOVING ANNULAR ELEMENTS TIGHTLY MOUNTED IN HOLES, IN PARTICULAR BLIND HOLES, OF PARTS

The present invention concerns a tool for removing annular elements tightly mounted in receiving holes, notably blind receiving holes, produced in parts.

The expression "annular element" designates generally rings, bushes or any other mechanical element of cylindrical or tubular shape with an axial passage through it, and these annular elements have for their main purpose supporting other circular mobile mechanical members, such as pivot pins, for centering and/or guiding purposes, as will emerge hereinafter with reference to a particular application to mounting rings.

Also, these annular elements must remain fixed relative to the parts receiving them and, to this end, they are a tight fit or even a force fit in the receiving holes, either by an appropriate fit of the sliding/clamped type, or by thermal means, by a temperature difference between the annular element and the part concerned. It is thus clear that when the "annular element-part" assembly is effected and the receiving hole in the part is blind, or possibly a through-hole but inaccessible from the side opposite that on which the annular element is mounted, for example because of a reduction in the diameter of the hole, it is necessary to use a specific removal tool to extract the annular element from the hole from the side of the part from which it was inserted.

This operation may arise for purposes of inspection and maintenance after wear of the annular element is noted or even on first mounting it in the hole, which may fail for various reasons.

In a particular, although not exclusive, application to the aeronautical field, the removal tool is intended, when this proves necessary, to remove rings tightly mounted in bored blind holes provided in the struts or legs of airframe landing gear. For example, these rings receive the pivot pins for pivoting of the main and nose landing gear between their respective retracted and deployed positions obtained by means of actuators, which pins are then centered and guided to the required tolerances in rings produced in copper, brass or steel, for example. Before mounting the articulation shafts, each ring is, on the one hand, immobilized axially in position relative to the corresponding bored hole by an external annular rim at the end pressing against the perimeter delimiting the blind bored hole of the strut and, on the other hand, in rotation relative to said hole by a pin or the like radially linking the ring and the strut. To this end, the pin passes through diametrically opposite radial orifices provided in the lateral wall of the ring and open orifices in corresponding relationship provided in the strut, perpendicularly to the bored hole.

Such an arrangement in particular enables prevention of rotation of the rings when the pins pivot and thus degrading the bored surface of the holes, the appearance of cracks, corrosion, etc. in the struts.

To remove these annular elements (rings) tightly mounted in the blind holes, for inspection or following wear or failed mounting, there is already known a tool of the type applying axial traction to said annular element and including:

- a tie-rod or shaft adapted to be engaged coaxially in the axial passage of said annular element;
- means of contact with said annular element, associated with said tie-rod; and
- drive means for acting on said tie-rod and extracting said annular element from said hole by virtue of the action of said contact means.

In the aforementioned application, the contact means take the form of a removal pin that is mounted, from one of the open holes of the strut, replacing that previously driven out for preventing rotation between the ring and the strut, and which is engaged in the radial orifices of the ring and a radial passage provided in the tie-rod and brought into corresponding relationship with the radial orifices of the ring. Obviously, the length of the removal pin must be significantly less than the outside diameter of the lateral wall of the ring, so that its ends are positioned at the radial orifices thereof. When this has been done, the drive means, such as an actuator the drive rod of which has been coaxially connected to the tie-rod beforehand, is actuated to raise the ring by means of the radial removal pin rigidly fastened to the tie-rod, and extracts it from the hole. A cylindrical part disposed between the strut and the actuator and coaxial with the tie-rod guides and holds the actuator relative to the strut.

Although giving satisfactory results, the above removal tool has drawbacks.

If the radial position of the removal pin is incorrect, i.e. if one of its ends projects slightly relative to the cylindrical lateral wall of the ring and consequently is engaged in the open radial orifice of said strut in corresponding relationship, removing the ring will necessarily damage the bored surface of the hole, generally by a groove caused by movement of the projecting end of the removal pin scratching said bored surface. Depending on its depth, in the best case scenario such a groove may lead to reboring of the hole concerned on a machine tool, which implies removal of the strut from the aircraft, but in the worst case scenario may go so far as requiring scrapping the strut, which is difficult to accept given the high cost of this part of the landing gear.

The removal tool may also be damaged, notably by the tie-rod breaking at the level of the removal pin if partially jammed in the radial orifice of the strut as a result of the traction force.

Moreover, a tool of this kind necessitates a power source to power the actuator, which makes it obligatory to move the airframe into a maintenance hanger or to provide a mobile hydraulic generator to power the actuator and work on the hard standing.

The documents U.S. Pat. No. 5,249,342 and U.S. Pat. No. 1,728,248 disclose removal tools that avoid deterioration of the parts, the contact means of which take the form of an annular cage with lateral claws that are elastically deformable in the radial direction to remove the annular element, such as a ring, from a hole in the part concerned.

The present invention concerns a removal tool with elastically deformable cage contact means of this kind the design whereof is simplified and guarantees sure and reliable removal of annular elements mounted in complex and costly parts without causing deterioration of the latter parts.

To this end, the tool for removal of annular elements such as rings tightly mounted in holes, notably blind holes, in parts, is of the type exerting axial traction on said annular element and includes:

- a tie-rod adapted to be engaged coaxially in the axial passage of said annular element and terminating at its distal end passing through said axial passage of the annular element in an enlarged head the diameter of which is less than the inside diameter of said axial passage of the element and which is fed into said hole beyond the distal transverse face of said annular element;
- means of contact with said annular element, taking the form of an annular cage with lateral claws that are elastically deformable in the radial direction, which cage surrounds said tie-rod and passes through said axial passage of the annular element in such a manner that the claws come to be pressed against said distal transverse face of the annular element; and drive means for acting on said tie-rod to extract said annular element from said hole through the action of the claws of said contact means driven by the enlarged head of the tie-rod.

According to the invention the tool is noteworthy in that the lateral claws of the annular cage are in a position deformed radially inwards when they pass through the axial passage of the annular element and, on exiting said passage, spontaneously resume their initial position with an outside diameter of the claws greater than the diameter of said axial passage of the annular element and less than the diameter of the said hole, and an inside diameter less than the diameter of said enlarged head, to be pressed against said distal transverse face of said annular element, so that said tie-rod, because of the action of said drive means, comes into contact with said claws of said cage by its enlarged head and drives said annular element out of said hole, and in that, in said enlarged head of said tie-rod, there is provided an external annular shoulder having a diameter at most equal to the inside diameter of said lateral claws when they occupy said initial position in order to receive them.

Accordingly, thanks to the invention, the cage is placed automatically by the spontaneous spreading of the claws as soon as the distal face of the element is passed, without recourse to additional components and adjustments. The action of the cage with elastic lateral claws for removing the annular element by means of the enlarged head of the tie-rod is effected with no deterioration of the bored surface of the hole, because the outside diameter of the claws in the initial "active" position is less than that of the hole. The annular element, such as a ring, is thus removed in a sure and reliable manner by sliding of the part without difficulty and without damaging the hole, which eliminates the operations of reworking (remachining) the latter and most importantly avoids scrapping the part (strut). Moreover, the annular element may be replaced in the blind hole if its condition justifies it or changed, of course. The removal tool, apart from its simple production by combining a tie-rod with an enlarged head and a cage with claws, therefore achieves significant cost savings. Moreover, when the enlarged head of the tie-rod acts axially on the claws of the cage to pull the annular element out of the hole, said claws are held radially with the same diameter as in the initial active position by engagement with the annular shoulder, with no tendency, because of their inherent elasticity, to be moved radially towards each other by the drive means. Thus the enlarged head ensures axial withdrawal of the cage whilst maintaining the radial position of the claws.

In a preferred embodiment, said lateral claws of said cage terminate in lugs projecting radially outwards, so as to be pressed against said distal transverse face of said annular element when said lateral claws go from their elastically deformed position in said axial passage to their initial position on exiting the latter passage. Said external radial lugs also have inclined faces to facilitate engagement of said lateral claws of the cage in said axial passage of the annular element.

In one particular embodiment of the cage, said lateral claws alternate with semi-open lateral slots provided in the lateral wall of said annular cage.

Moreover, the removal tool further includes a bell-shaped cylindrical part adapted to have its free end pressed onto the perimeter of said receiving hole of the annular element and having, in its transverse bottom end, a central orifice for said tie-rod to pass through. This cylindrical part in particular ensures retention and centering of the tool on the part (strut) including the annular element to be removed and receiving the latter.

In a preferred embodiment, said drive means are of the screw type and include a screwthread provided on said tie-rod and a controllable nut mounted on said screwthread. Note the simple way in which the tool is driven, said nut being movable manually by means of a wrench or motorized by means of appropriate equipment.

Said nut of the drive means is advantageously situated, during removal of said annular element, bearing on the transverse bottom of said cylindrical part via a thrust ball bearing. The proximal end of said tie-rod is provided with an imprint for insertion of a wrench or the like. Thus, holding the tie-rod in position with the wrench, the nut of the drive means may be acted on to extract the tie-rod from the blind hole and to remove the annular element by virtue of the action of the claws of the cage.

The figures of the appended drawings show how the invention may be put into practice. In these figures, identical references designate similar elements.

Figure 1:
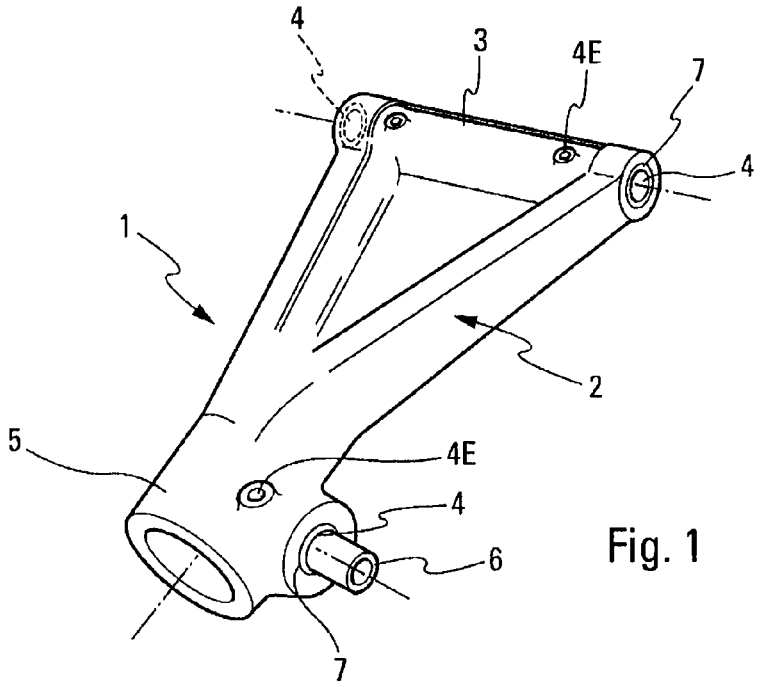
FIG. 1 is a diagrammatic perspective view of an airframe landing gear the strut of which is provided with annular elements adapted to be removed by the tool of the invention.

FIG. 1 shows only the strut 2 of the landing gear 1. In the upper part 3 thereof are provided aligned holes or housings 4 for receiving pivot pins, not shown, around which the strut 2 pivots during retraction and deployment of the landing gear 1 by a driving actuator. In the lower part 5 of the strut is the hole or housing for receiving another support and/or pivot pin indicated by the reference 6. In these receiving holes are mounted annular cylindrical elements such as rings 7 adapted to receive the various aforementioned shafts with the required mechanical tolerances and the required geometrical conditions in respect of centering and guiding, in such a manner as to avoid and prevent wear and/or deterioration of the lateral walls of the holes in the strut.

Figure 2:
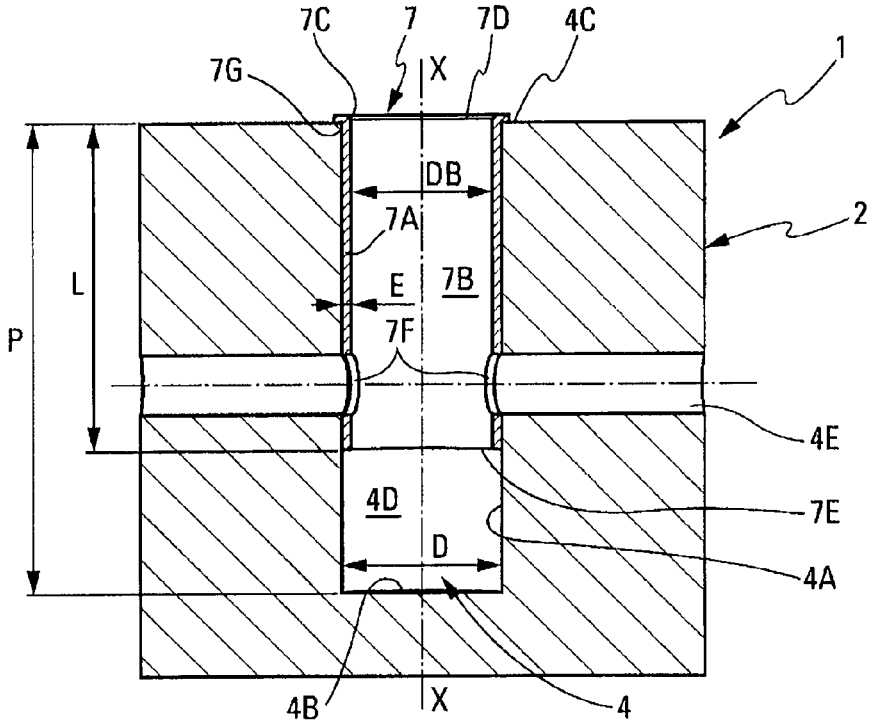
FIG. 2 is a view in axial section of one of said annular elements tightly mounted in its receiving hole in the strut.

One of the receiving holes 4 produced in the strut 2 is more particularly represented in FIG. 2, on the understanding that the other holes are of structurally identical design, the only possible differences being in terms of dimensions. As may be seen, the receiving hole 4 is a blind hole, with axis X-X, and has a diameter D obtained by boring to a depth P. It is thus delimited by its circular lateral wall or surface 4A and by a flat transverse bottom 4B.

This hole 4 accommodates the tubular cylindrical ring 7, which is tightly mounted in the hole (notably by sliding/clamping or by means of a temperature difference). This ring 7 is composed of a thin cylindrical wall 7A of annular section of thickness E, defining the inside diameter DB of the internal axial passage 7B of the ring (the outside diameter being substantially equal to the diameter D of the hole), and an external annular rim 7C at the end that comes to abut axially against the circular perimeter 4C delimiting the entrance of the blind hole 4 in the strut 2. This external rim 7C constitutes the proximal transverse face 7D of the ring, close to the operator, as will emerge hereinafter, while the distal transverse face 7E of the ring faces toward the transverse bottom 4B of the blind hole 4. Note that the length L of the ring (annular element) is less than the depth P of the blind hole, with the result that the distal transverse face 7E of the ring is at a distance from the transverse bottom 4B forming, between the distal face and the bottom, a free space 4D having the diameter D. In this example, the length L of the ring corresponds to two thirds of the depth P of the hole, although this ratio may of course vary.

It is further seen in FIG. 2 that the lateral wall 7A of the ring is diametrically bored in the vicinity of the distal transverse face and thus has two aligned radial orifices 7F which, after the ring is mounted in appropriate manner, come into corresponding relationship with open orifices 4E (FIGS. 1 and 2) formed in the strut 2, perpendicularly to the receiving hole 4. A pin, not shown, is mounted in these various aligned orifices and thus immobilizes the ring against rotation relative to the receiving hole in the strut. For the purpose of removing the ring 7, this pin has been driven out of the orifices 7F, 4E and is therefore not shown in FIG. 2.

Figure 3:
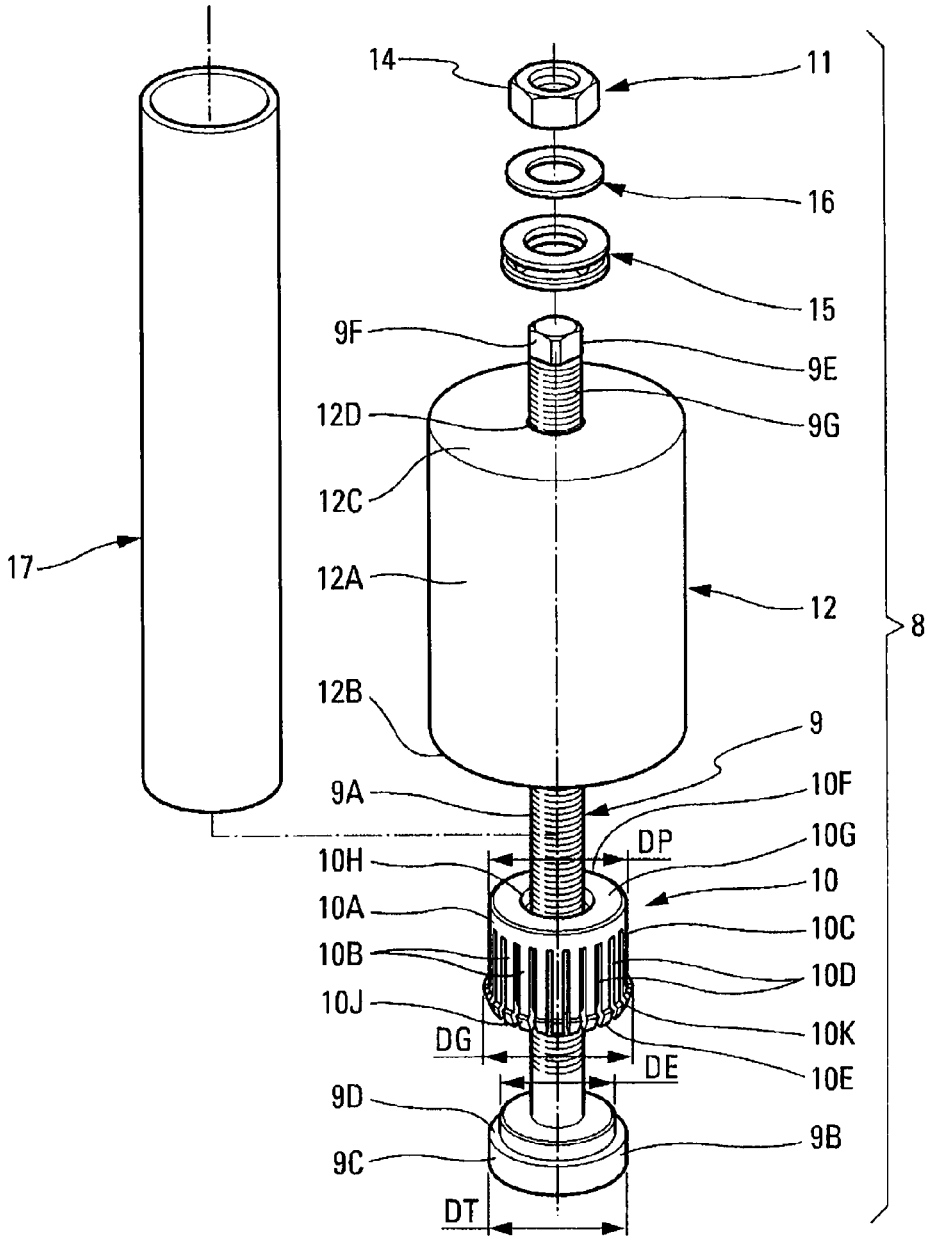
FIG. 3 is an exploded perspective view of the various components of the removal tool of one particular embodiment of the invention.

As FIG. 3 shows more particularly, the tool 8 for removing the ring 7 from the blind hole 4 is composed of:

- a tie-rod 9 adapted to be coaxially engaged in the axial passage 7B of the ring 7;
- means 10 of contact with the ring, associated with the tie-rod 9 upon axial movement thereof;
- drive means 11 for moving the tie-rod 9 and acting on the contact means 10 to remove the ring 7 from the blind hole; and
- a bell-shaped cylindrical part 12 for guiding movement of the tie-rod and facilitating operation of the drive means.

All these components of the tool 8 are thus centered on the same geometrical axis which when the tool is mounted in the hole 4 coincides with the axis X-X of the latter hole.

More particularly, the tie-rod takes the form of a cylindrical rod 9A the distal end 9B of which, facing the blind hole, includes an enlarged cylindrical head 9C the diameter DT of which is at most equal to, preferably slightly less than, the inside diameter DB of the axial passage 7B of the annular ring 7. An annular shoulder 9D is moreover produced in the head 9C, on the same side as the rod 9A, so as to have a diameter DE the function of which will be described hereinafter. As for the proximal end 9E of the tie-rod, it is defined by an imprint such as a drive square 9F, while the rod 9A has a screwthread 9G from this square as far as the vicinity of the enlarged head.

Where the contact means 10 are concerned, they are defined by an annular cage 10A with lateral claws 10B elastically deformable in the radial direction. To this end, in the cylindrical wall 10C of the annular cage semi-open slots 10D are provided extending from the distal first end 10E intended to be engaged in the axial passage 7B of the ring as far as the vicinity of the proximal second end 10F terminating in a transverse bottom 10G pierced by a central orifice 10H for the rod 9A of said tie-rod to pass through. Between the slots 10D regularly distributed around the cylindrical wall 10C the identical lateral claws 10B are thus created. Each lateral claw is terminated by an external radial lug 10J with an inclined face 10K so that the outside diameter DG of the claws at the level of the periphery of the radial lugs 10J is preferably slightly less than the diameter D of the hole 4 and thus greater than the inside diameter DB of the ring 7 when the claws 10B are in a neutral initial idle position with no deformation, as in FIGS. 3 and 6A.

As will emerge hereinafter, the claws may move radially toward each other and assume a deformed position, by virtue of their elasticity, with a smaller diameter equal to that of the axial passage 7B, and then spontaneously revert to their diameter DG.

Figure 8A:
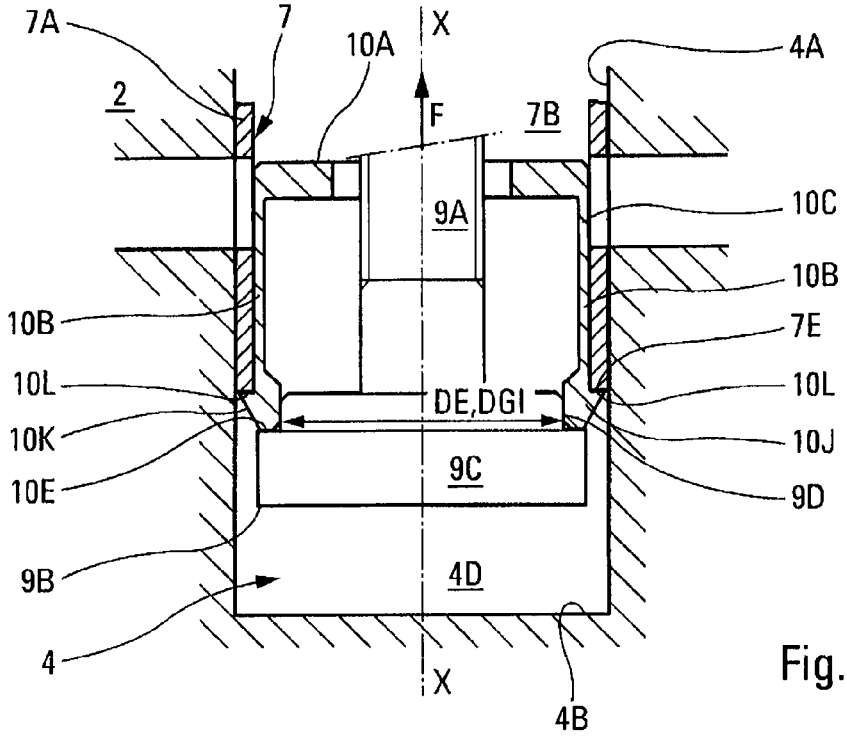

Note, moreover, that the inside diameter DGI of the claws 10B (FIGS. 6A and 8A), when they occupy their neutral position, is close to or at least equal to the diameter DE of the shoulder 9D provided in the enlarged head 9C of the tie-rod.

The bell-shaped cylindrical part 12 for its part has (FIGS. 3 and 7) a lateral wall 12A an annular transverse end 12B of which is adapted to be pressed against the face of the strut 2 onto which the blind hole 4 opens, but around the annular rim 7C of the ring. The other end of the bell-shaped part 12 is conformed as a transverse bottom 12C having at its center and orifice 12D for the tie-rod 9 to pass through.

With regard to the drive means 11, in this non-exclusive embodiment, they are of the screw type and, to this end, are composed of the screwthread 9G provided on the rod 9A of the tie-rod and a nut 14 screwed onto the screwthread and intended to be pressed onto the transverse bottom 12C of the bell-shaped part 12 via a thrust ball bearing 15 and a washer 16, as described hereinafter.

Finally, the removal tool 8 includes a cylindrical tube or the like intended for pushing the cage 10A axially inwards and to this end having a diameter corresponding approximately to that of the cage, for example slightly less than the diameter DB of the axial passage in the ring 7.

How the removal tool 8 of the invention works is described hereinafter with reference to FIGS. 4 to 9 and 6A, 8A.

The procedure for removing the ring 7 force-fitted into the blind bored hole 4 in the strut 2 is as follows.

Figure 4:
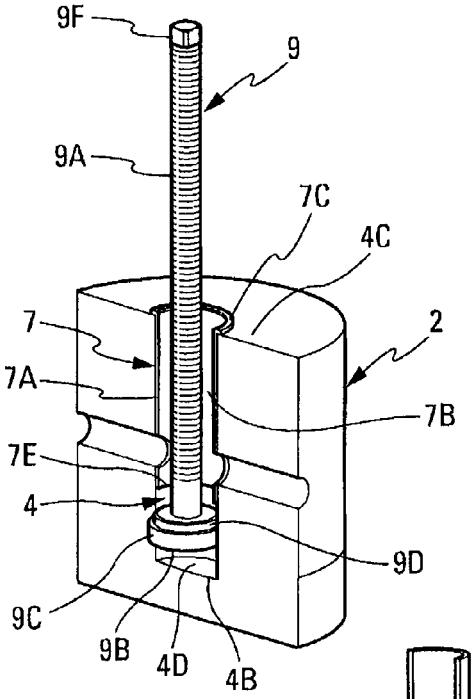
FIGS. 4 to 9 are sectional perspective views of the main phases of operation of said tool to remove the annular element from its hole.

As FIG. 4 shows, the distal end 9B of the tie-rod 9 is introduced into the hole 4 through the axial passage 7B of the ring 7. As the diameter DT of the enlarged head 9C of the distal end is close to the diameter DB of the axial passage, the tie-rod 9 is guided and centered relative to the axis X-X of the hole 4. The enlarged head 9C of the tie-rod 9 goes beyond the ring 7 into the free space 4D of the hole between the latter ring and the transverse bottom 4B in the manner shown. Obviously, the enlarged head may come into contact with the transverse bottom.

Figure 5:
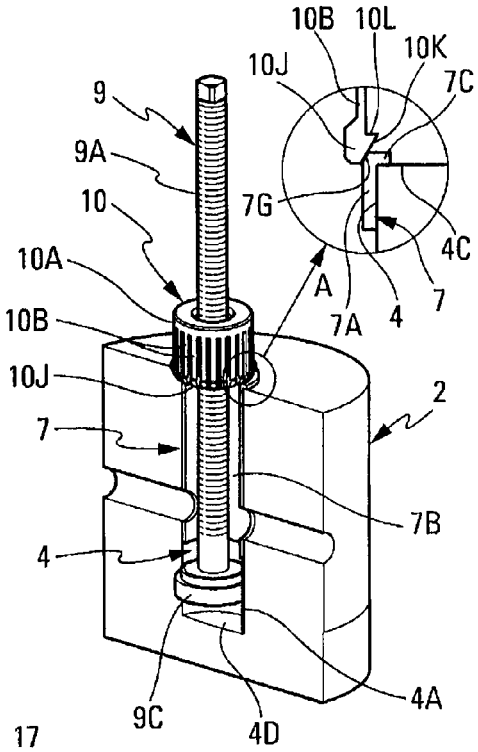

Then, as FIG. 5 shows, the cage 10A of the contact means 10 is disposed around the threaded rod 9A of the tie-rod to be brought into contact with the annular rim 7C of the ring through the lateral claws 10B. More particularly, as the enlargement A of this figure shows, the inclined faces 10K of the claws are pressed onto a chamfer 7G connecting the internal surface of the lateral wall 7A of the ring to the exterior transverse surface of the radial annular rim 7C.

By means of the cylindrical tube 17 mounted around the tie-rod 9 and pressing against the transverse bottom 10G of the second end of the cage 10A, and a mallet, not shown, for hitting the tube 17, the latter tube progressively drives the cage 10A into the axial passage 7B of the ring. This is possible thanks to the elasticity of the lateral claws 10B which, as the inclined faces 10K advance over the bevel 7G, move radially toward each other relative to the longitudinal axis X-X to then slide in a deformed position along the surface delimiting the axial passage 7B of the ring. To facilitate guiding of the cage in the axial passage, the outside diameter DP of its cylindrical lateral wall 10C is close to, or at most equal to, apart from the functional clearance, the inside diameter DB of the ring.

Figure 6:
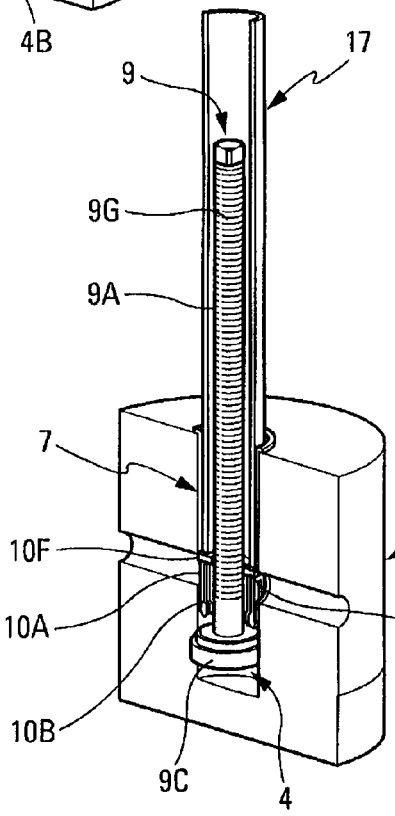
Figure 6A:
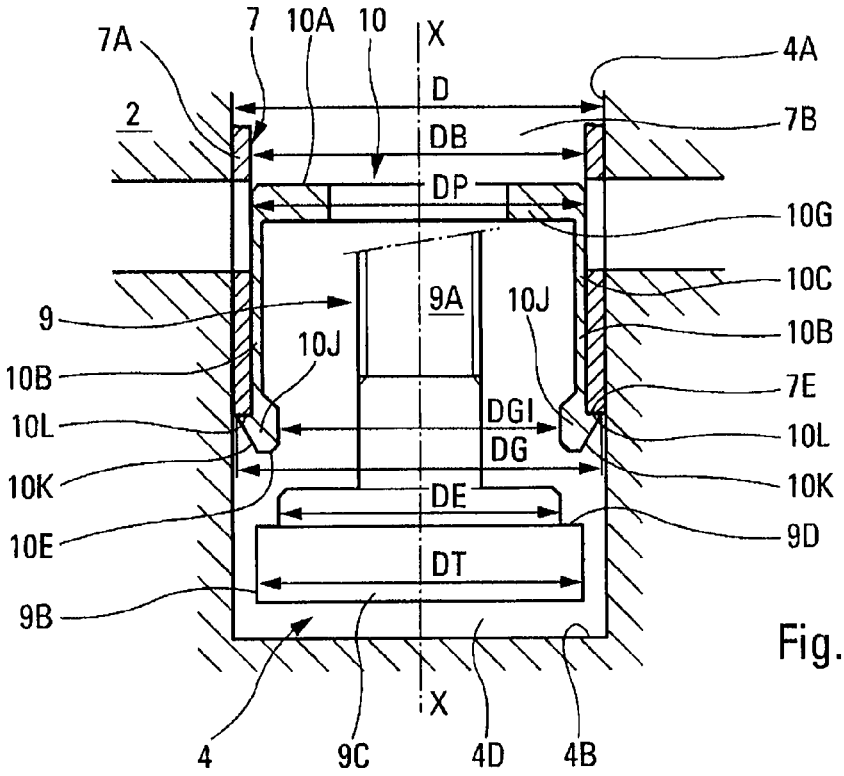
FIGS. 6A and 8A are axial sections to a larger scale showing the cage with claws and the enlarged head of the tie-rod before and after their cooperation, corresponding to the phases of FIGS. 6 and 8.

The tube 17 continues to be pushed in axially until the lateral claws 10B exit the transverse distal face 7E of the ring and spontaneously resume their initial position, moving radially away from each other because of their elasticity. At this moment, as FIGS. 6 and 6A show, the lugs 10J of the claws projecting radially outward are engaged by their rear face 10L on the annular transverse face 7E of the distal end. The outside diameter DG of the claws is then close to the diameter D of the hole 4, so that the transverse face 7E of the ring 7 is "captured" over virtually the whole of its surface by the rear faces of the claws, with the advantage of not touching the bored lateral wall 4A of the hole.

Figure 7:
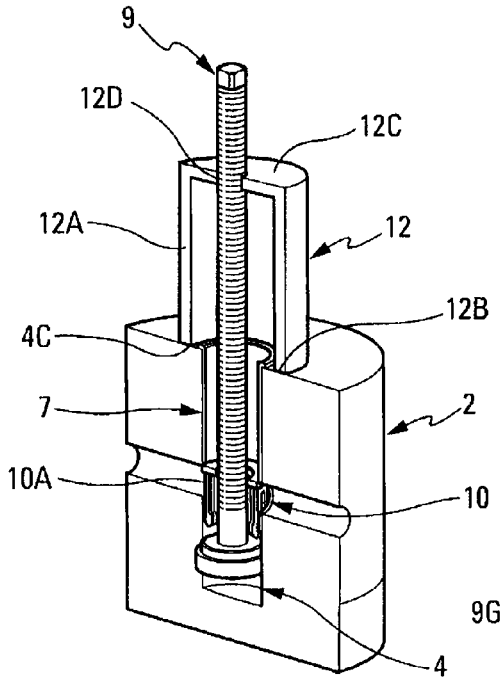

The cylindrical tube 17 is removed from the tie-rod and, as FIG. 7 shows, the bell-shaped cylindrical part is disposed around the threaded rod 9A of the tie-rod by means of the orifice 12D in its transverse bottom 12C. It is then slid along the rod until the annular end 12B of the cylindrical wall 12A makes contact with the surface 4C concerned of the strut 2.

Figure 8:
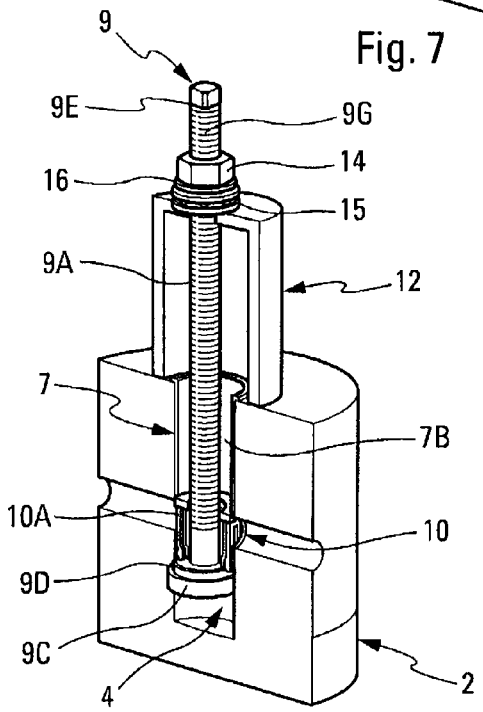

As seen in FIG. 8, the thrust ball bearing 15 is mounted around the rod 9A so as to come to bear axially on the transverse bottom 12C of the bell-shaped part, then the washer 16, and finally the nut 14 of the drive means 11. The latter nut is screwed onto the screwthread 9G until it comes into contact with the washer. At this moment, as the nut 14 when rotated by a wrench that is not shown is in an axial abutment position, its rotation drives axial withdrawal of the threaded rod 9A of the tie-rod 9 in the direction of the arrow F in FIG. 8A, so that the enlarged head 9C of the latter tie-rod rises relative to the blind hole 4 and therefore the ring 7. It is clearly seen in FIG. 8A that the cylindrical shoulder 9D of the head 9C is then progressively engaged axially between the lateral claws 10B thanks to their similar respective diameters DE, DGI, radially immobilizing them in the initial position. The tie-rod 9 is then in contact with the cage 10A with the lateral claws 10B.

Figure 9:
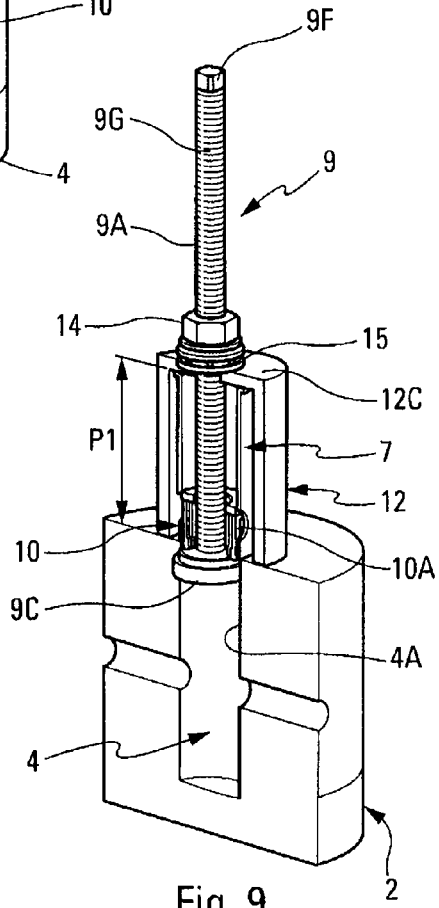

Continued rotation of the nut 14, with the tie-rod 9 preferably held by means of a tool (wrench, etc.), not shown, to prevent it rotating, said tie-rod, by virtue of the screwthread 9G on its rod, is driven axially out of said hole 4, bringing the ring 7 with it. FIG. 9 shows the moment at which the removal tool 8 has extracted the ring 7 from the blind hole 4 by the combination of the enlarged head 9C of the tie-rod 9 and the cage 10A with the elastic claws 10B. Note in FIG. 9 that the depth P1 of the internal housing of the bell-shaped part is sufficient to receive the ring 7, i.e. is at least equal to the length L of the latter ring.

As seen in these figures, the extraction of the ring initially driven into the blind hole is effected without deterioration of the bored surface of its lateral wall, or even of the ring itself. Such a removal tool may therefore be used universally whenever an annular element tightly mounted in a hole must be removed therefrom for maintenance or other reasons. Moreover, because its design and operation are purely mechanical, it may be used where the parts equipped with the annular elements are located, that is to say, in the above application, where the aircraft is parked.

The invention claimed is:

1. A tool for removal of annular elements or rings, tightly mounted in holes, or in blind holes, in parts, of type exerting axial traction on the annular element, the tool comprising:

a tie-rod adapted to be engaged coaxially in the axial passage of the annular element and terminating at its distal end passing through the axial passage of the annular element in an enlarged head having a diameter less than the inside diameter of the axial passage of the element and which is fed into the hole beyond a distal transverse face of the annular element;

means for contact with the annular element, taking a form of an annular cage with lateral claws that are elastically deformable in the radial direction, which cage surrounds the tie-rod and passes through the axial passage of the annular element such that the claws come to be pressed against the distal transverse face of the annular element; and drive means for acting on the tie-rod to extract the annular element from the hole through action of the claws of the contact means driven by the enlarged head of the tie-rod, wherein the lateral claws of the annular cage are in a position deformed radially inwards when they pass through the axial passage of the annular element and, on exiting the passage, spontaneously resume their initial position with an outside diameter of the claws greater than the diameter of the axial passage of the annular element and less than the diameter of the hole, and an inside diameter less than the diameter of the enlarged head, to be pressed against the distal transverse face of the annular element, so that the tie-rod, because of action of the drive means, comes into contact with the claws of the cage by its enlarged head and drives the annular element out of the hole, and wherein, in the enlarged head of the tie-rod, there is provided an external annular shoulder having a diameter at most equal to the inside diameter of the lateral claws when they occupy their initial position to receive them.

2. The tool as claimed in claim 1, wherein the lateral claws of the cage terminate in lugs projecting radially outwards, so as to be pressed against the distal transverse face of the annular element when the lateral claws go from their elastically deformed position in the axial passage to their initial position on exiting the axial passage.

3. The tool as claimed in claim 2, wherein the external radial lugs also have inclined faces to facilitate engagement of the lateral claws of the cage in the axial passage of the annular element.

4. The tool as claimed in claim 1, wherein the lateral claws alternate with semi-open lateral slots provided in the lateral wall of the annular cage.

5. The tool as claimed in claim 1, further comprising a bell-shaped cylindrical part adapted to have its free end pressed onto the perimeter of the receiving hole of the annular element and having, in its transverse bottom end, a central orifice for the tie-rod to pass through.

6. The tool as claimed in claim 1, wherein the drive means are of screw type.

7. The tool as claimed in claim 6, wherein the screw-type drive means include a screwthread provided on the tie-rod and a controllable nut mounted on the screwthread.

8. The tool as claimed in claim 5, wherein a nut of the drive means is situated, during removal of the annular element, bearing on the transverse bottom of the cylindrical part via a thrust ball bearing.

9. The tool as claimed in claim 1, wherein the proximal end of the tie-rod includes an imprint for insertion of a wrench or other tool.

* * * * *